US005603635A

United States Patent [19]

Delamotte et al.

[11] Patent Number: 5,603,635

[45] Date of Patent: Feb. 18, 1997

[54] ELECTRICAL CONNECTOR

[75] Inventors: Jean-Christian Delamotte, Henonville; Jacqueline Damene, Pierrelaye, both of France

[73] Assignee: Raychem S.A., France

[21] Appl. No.: 313,314

[22] PCT Filed: Apr. 7, 1993

[86] PCT No.: PCT/GB93/00733

§ 371 Date: Oct. 31, 1994

§ 102(e) Date: Oct. 31, 1994

[87] PCT Pub. No.: WO93/21669

PCT Pub. Date: Oct. 28, 1993

[30] Foreign Application Priority Data

Apr. 9, 1992 [GB] United Kingdom ..... 9207868

[51] Int. Cl.[6] ..... H01R 9/05

[52] U.S. Cl. ..... 439/581; 439/932

[58] Field of Search ..... 439/581, 932, 439/730, 582

[56] References Cited

U.S. PATENT DOCUMENTS

| | | | |
|---|---|---|---|
| 2,863,132 | 12/1958 | Sowa | 439/932 X |
| 3,743,748 | 7/1973 | Reeder | 439/932 X |
| 3,980,382 | 9/1976 | Reeder | 439/581 OR |
| 4,060,887 | 12/1977 | DeGroef | 29/626 |
| 5,334,050 | 8/1994 | Andrews | 439/581 X |

FOREIGN PATENT DOCUMENTS

| | | |
|---|---|---|
| 0306343 | 3/1989 | European Pat. Off. . |
| WO88/09068 | 9/1993 | European Pat. Off. . |
| 2218719 | 9/1974 | France . |
| 1232755 | 5/1971 | United Kingdom . |
| 1404715 | 9/1975 | United Kingdom . |

*Primary Examiner*—P. Austin Bradley
*Assistant Examiner*—Daniel Wittels
*Attorney, Agent, or Firm*—Herbert G. Burkard; Sheri M. Novack

[57] ABSTRACT

A device for electrically connecting a coaxial cable to another electrical component comprises a sleeve for receiving an end of the coaxial cable, the sleeve having a pair of elongate conductive members that extend out of the sleeve from the interior thereof for forming a connection with the electrical component and two quantities of solder for connecting each conductive member to a conductor of the coaxial cable, wherein the sleeve is a unitary sleeve and the conductive members both extend out of the same end of the sleeve, at least one of the elongate conductive members being electrical insulated in order to prevent a short circuit between the conductive members. Also disclosed are a plurality of such devices located on a strip which joins at least one of the conductive members of each device, and a method of manufacturing the devices.

7 Claims, 3 Drawing Sheets

ELECTRICAL CONNECTOR

This invention relates to electrical connectors, and in particular to connectors for forming electrical connections to coaxial cables.

It is often necessary to form a connection between a coaxial cable and a printed circuit board (PCB) or other electrical component and a number of devices for forming such connections have been proposed, for example as described in U.S. Pat. Nos. 3,743,748 and 4,060,887, the disclosures of which are incorporated herein by reference. One such device which has been widely employed is that sold by Raychem Corporation under the registered trademark "PinPak". This device comprises a dimensionally heat-recoverable sleeve that is formed from a pair of component sleeves, each of which contains a quantity of solder. The sleeves are of different sizes and one end of the larger sleeve and a bond is formed between the sleeves by means of a ring of adhesive. A piece of wire is bent so that each end can be inserted into one of the sleeves (one end into the small sleeve and one end into the end of the larger sleeve that contains the smaller sleeve), and the sleeves are partially recovered to grip the wire. In order to terminate a coaxial cable the cable, after cutting back the jacket, outer conductor and dielectric by appropriate amounts, is inserted into the sleeve and the sleeve is heat recovered about the cable so that the conductors of the cable are each connected to one end of the wire by means of the solder. Afterwards the central portion of the wire can be removed by means of snips, so that the remaining parts of the wire act as pins for insertion into a PCB or other device.

Although this type of connector works well in practice it is relatively complex and requires a complex manufacturing process: The smaller of the two sleeves must be partially recovered about one end of the wire and a solder preform, the larger sleeve must be partially recovered about another solder preform and a ring of adhesive, and finally the larger sleeve must be accurately positioned over the end of the smaller sleeve and the free end of the wire and partially recovered thereon.

This invention has, as its object, the provision of a similar coaxial cable connection device that can be produced by means of a less complex process. According to one aspect, the invention provides a device for electrically connecting a coaxial cable to another electrical component, which comprises a sleeve for receiving an end of the coaxial cable, the sleeve having a pair of elongate conductive members that extend out of the sleeve from the interior thereof for forming a connection with the electrical component, which may for example be a printed circuit board, and two quantities of solder for connecting each conductive member to a conductor of the coaxial cable, wherein the sleeve is a unitary sleeve and the conductive members both extend out of the same end of the sleeve, at least one of the elongate conductive members being electrically insulated in order to prevent a short circuit between the conductive members. By the expression 'unitary sleeve' is meant a sleeve having a single aperture out of which both elongate conductive members extend.

The device according to the invention can be manufactured by:

(i) forming a pair of elongate conductive members that are connected together at one end and have one free end;

(ii) providing at least one of the conductive members with electrical insulation;

(iii) bending the conductive members so that their free end portions are brought into proximity but are offset from one another, are substantially parallel and extend in the same direction; and (iv) locating a sleeve on the free end portions of the conductive members, the sleeve having two quantities of solder for connecting each conductive member to one conductor of the coaxial cable.

This invention has the advantage that the total number of components that need at some stage to be individually handled is reduced, thereby allowing the possibility of lower manufacturing costs. For example, only one sleeve is employed and the relatively difficult requirement of locating one sleeve within another is removed.

Preferably the sleeve is dimensionally heat-recoverable, that is to say the article has a dimensional configuration that may be made substantially to change when subjected to heat treatment. Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate state.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Any material to which the property of dimensional recoverability may be imparted may be used to form the sleeve. Preferred materials include low, medium or high density polyethylene, ethylene copolymers, eg. with alpha olefins such as 1-butene or 1-hexene, or vinyl acetate, polyamides or fluoropolymers, eg. polytetrafluoroethylene, polyvinylidine fluoride or ethylene-tetrafluoroethylene copolymer.

The conductive members will normally be joined together outside the sleeve in order to make the devices more robust when they are being handled, the portion of the assembly that joins the two members being cut out, eg. by means of snips or a pair of pliers, after the cable has been connected, to form a pair of pins. Thus the assembly is normally in the form of a substantially rectangular loop of wire having two opposite sides (which sides form the pins) that are substantially perpendicular to the axis of the sleeve. Since the sides are separated from one another along the axis of the sleeve and both parts of the wire exit from the same point of the sleeve, one part of the wire will need to be bent back on itself. On one embodiment, a portion of the wire (at least one of the conductive members) is bent double where it exits the sleeve, thereby gripping the sleeve between the portions thereof on opposite sides of the bend. If desired, however, alternative means may be employed for holding the conductive members in place, for example they may extend in the interior of the sleeve between the sleeve wall and the solder preform, in which case the sleeve may be partially recovered to grip the conductive members against the solder.

In view of the fact that the parts of the conductive members that are located inside the sleeve will be in close proximity, normally touching one another, and because one of the conductors will need to pass through the solder connection formed between the other conductive member and one of the conductors of the coaxial cable, at least one of the conductors will need to be electrically insulated along at least part of its length where appropriate but is retained along a certain portion. Alternatively a length of thin heat-shrinkable tubing may be shrunk onto the conductive member. A further way of insulating the conductive members is by means of a lacquer or enamel.

The devices may be formed individually or they may be provided on a strip so that a bandolier of devices with appropriate inter-device spacing may be produced and employed with automatic installation equipment or may be employed in multicable connectors, eg. flat connectors, in which a plurality of coaxial cables are terminated. In such a case it is appropriate for the strip to join at least one of the conductive members of each device. For example, and preferably, both conductive members are attached to the strip, and the strip is cut away after the coaxial cables have been terminated in the sleeves.

Thus, according to another aspect, the invention provides a method of manufacturing a plurality of devices for electrically connecting a coaxial cable to a printed circuit board, which comprises:

(i) forming a strip of metal from which two sets of elongate conductive members extend;

(ii) providing the conductive members of at least one set with electrical insulation;

(iii) bending the conductive members so that the end portions remote from the strip of each conductor of one set are brought into proximity with the end portions remote from the strip of the corresponding conductor of the other set but are offset from one another, are substantially parallel and extend in the same direction; and (iv) locating a sleeve on the free end portions of each pair of conductive members, the sleeve having two quantities of solder for connecting each conductive member to one conductor of the coaxial cable.

The strip and conductive members are preferably formed by stamping them from a sheet of metal. After stamping sleeves may be recovered onto each conductive member of one of the sets and the conductive members may then be bent into the required shape, or alternatively each of the legs in one set may be coated with one or more coats of lacquer and optionally heated to dry and/or cure the lacquer either before or after the bending step.

The solder employed in the device is a soft solder as distinct from brazing material. The solder may, for example, simply be in the form of an $Sn_{63}Pb_{37}$ eutectic composition which will melt as the device is heated and the sleeve recovers, or more than one solder composition having differing melting points may be employed, as described in International Application No. WO88/09068. In this form of device, melting of the higher melting point component, eg. $Sn_{96.5}Ag_{3.5}$ eutectic will provide a visual indication that the device has been heated sufficiently to melt the lower melting point composition and to form a satisfactory solder joint. If desired the lower melting point solder may be a non-eutectic composition and, for example as described in International Application No. PCT/GB90/00234, the higher and lower melting point solder compositions may together form a eutectic composition. For example, a non-eutectic $Sn_{60}Pb_{40}$ lower melting point component may be employed with a higher melting point component formed from pure tin in relative amounts that an $Sn_{63}Pb_{37}$ eutectic is formed. The disclosures of these two patent applications are incorporated herein by reference. An advantage of employing a two component solder, and especially a tin, $Sn_{60}Pb_{40}$ combination is that it reduces the possibility of "wicking" that is to say, travel of the solder along the conductors and away from the joint area due to capillary action by the stranded conductors, which can be caused by prolonged heating of the device.

The heat-recoverable sleeve that is located on the conductive members is novel per se, and so, according to yet another aspect, the invention provides a dimensionally heat-recoverable sleeve for connecting a coaxial cable to a pair of elongate conductive members, the sleeve being of unitary form and containing two quantities of solder for connecting each conductive member to one of the conductors of the coaxial cable, and the sleeve having a guide channel to allow insertion of a pair of elongate conductive members therein so that each conductive member can be inserted only as far as a different quantity of solder.

The sleeve may be employed for connecting a coaxial cable to a number of different conductors. For example the sleeve may be positioned on a pair of conductive members as described above. Alternatively it may be positioned on a pair of pins that extend from a connector, or it can be positioned on a pair of pre-stripped wires if desired.

Several devices in accordance with the present invention will now be described by way of example, with reference to the accompanying drawings, in which.

Figure 1:
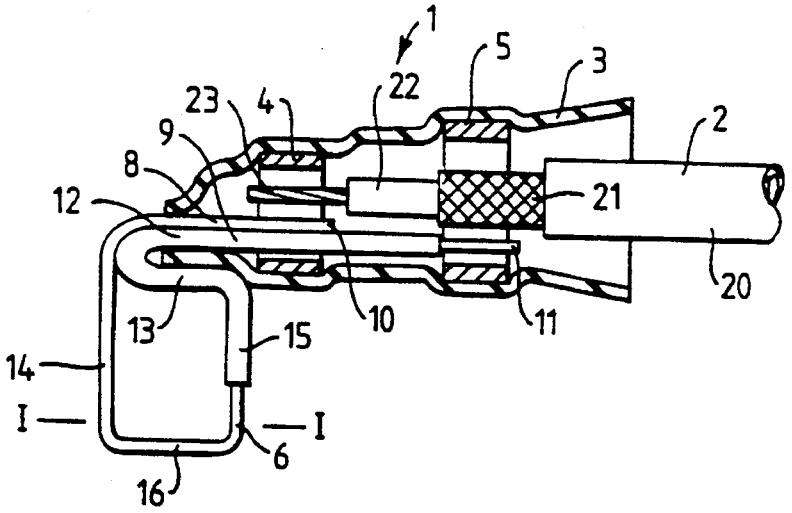
FIG. 1 is a side sectional elevation of a connector in according to the present invention.
Figure 2:
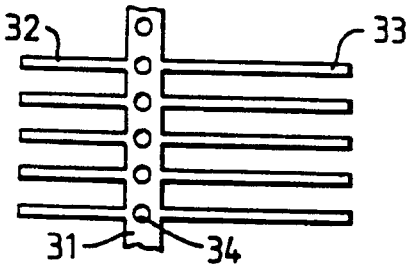
FIGS. 2 to 5 show various stages during the manufacture of a device according to the invention.

Referring to the accompanying drawings, FIG. 1 shows a device 1 according to the invention together with an end portion of a coaxial cable 2 inserted therein. The device 1 comprises a sleeve 3 formed from crosslinked polyvinylidine fluoride that has been expanded to render it dimensionally heat-recoverable. The sleeve contains a pair of solder rings 4 and 5 that are axially separated and are of different sizes. In addition the device includes a wire 6, part of which has been insulated by means of a heat-shrinkable sleeve recovered thereon. The wire is bent into a substantially rectangular loop and has two end portions 8 and 9 that have been brought together, and extend in the same direction and are substantially parallel. The ends of the wire are offset so that when the sleeve is installed on the wire as shown in FIG. 1 the ends 10 and 11 of the wire are each located within a different solder ring 4 and 5. The insulating sleeve 7 extends from a region adjacent to the end 11 of the wire to an intermediate region of the wire, and insulates the end region 9 of the wire from the end region 8 of the wire and from any solder connection between end region 8 of the wire formed by the solder ring 4.

As soon as the insulated portion of the wire exits the sleeve it is bent back on itself to form a "U" shaped portion having an arm 12 inside the sleeve 3 and an arm 13 outside the sleeve. This "U" shaped portion will grip the part of the wall of the sleeve 3 enclosed therein when the sleeve is partially recovered, with the result that the wire and the sleeve are held together. The substantially rectangular loop formed in the wire has a pair of opposed sides 14 and 15 which extend substantially perpendicularly from the axis of the sleeve 3, and an intermediate part 16 of the wire joins the two sides together.

In order to terminate a coaxial cable 2 for connection to a pcb, the jacket 20, braid 21, and dielectric 22 are each cut back so that an appropriate length of the central conductor 23, dielectric and braid are exposed. The end of the coaxial cable is then inserted into the open end of the sleeve 3 as shown in FIG. 1 so that the central conductor 23 and the braid 21 are in register with the solder rings 4 and 5 respectively. The sleeve is then heated by means of a hot-air gun or an infrared lamp in order to cause the sleeve 3 to recover about the coaxial cable 2 and the solder rings 4 and 5 to fuse and form solder connections between the wire 6 and the conductors of the coaxial cable. Finally the wire 6 is cut at the position of line I—I to remove the intermediate part 16 and a small portion of each opposed side 14 and 15 so that the remaining portions of the wire 6 form a pair of connection pins for connection to the pcb.

FIGS. 2 to 5 show various stages in the manufacture of a strip of identical devices according to the invention. A strip 31 formed from tinned copper has a set of pins 32 extending from one side thereof and a further set of slightly longer pins 33 extending from the other side thereof. The strip is formed by stamping the profile (and the registration holes 34) from a sheet of copper followed by a conventional tinning process.

Figure 3:
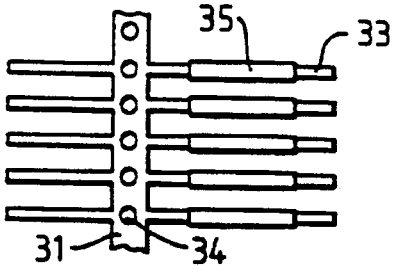
Figure 4:
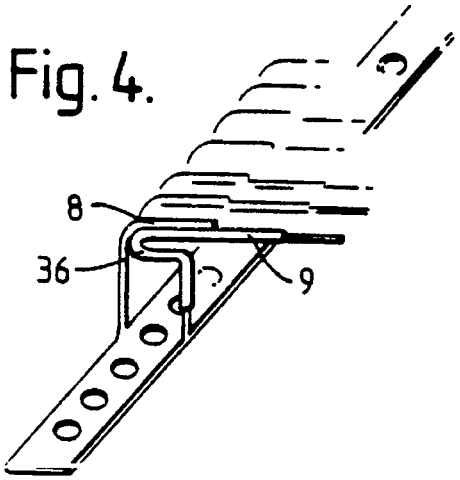
Figure 5:
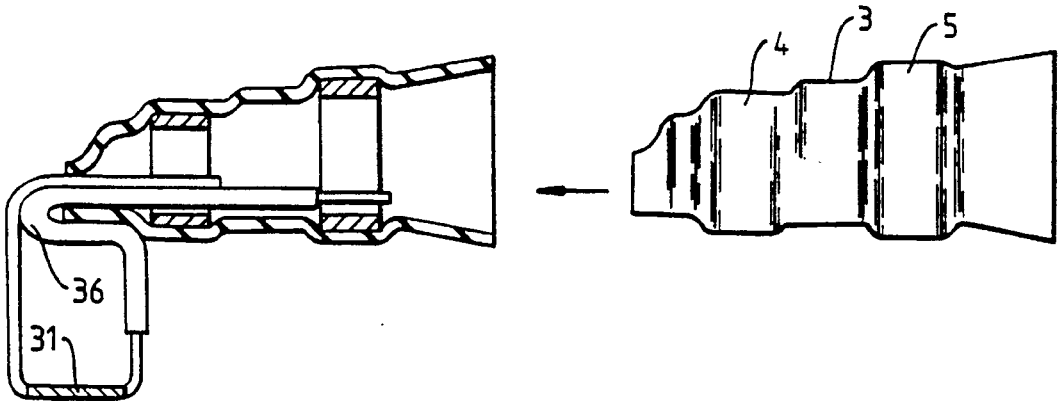

In the next step, lengths of heat-shrinkable tubing 35 are positioned on the set of longer pins 33 and heated to recover them about the pins, as shown in FIG. 3. The pins are then bent into the configuration shown in FIG. 4 in which a portion of each pin 32 and 33 adjacent to the strip 31 extends normally to the plane of the strip, and an end portion 8 and 9 of the pins have been brought together and extend parallel to one another. In addition, part of the longer pin has a U-shaped bent portion 36.

A heat-recoverable polyvinylidine fluoride sleeve 3 partially recovered about a pair of solder rings 4 and 5 in order to grip them. This sleeve is then pushed onto one of the pair of bent pins so that part of the wall of the sleeve is gripped by the bent portion 36 of the pin 33. In this way a strip of identical devices can be formed. Provision of the strip 31 facilitates handling of the devices by automated equipment and also enables a number of coaxial cables to be terminated simultaneously.

Figure 6A:
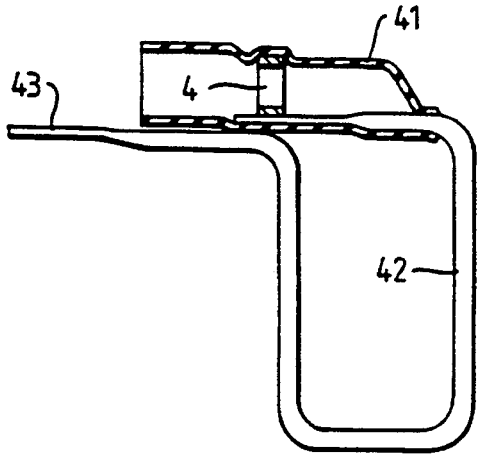
FIG. 6 shows a conventional coax-pcb termination device.
Figure 6B:
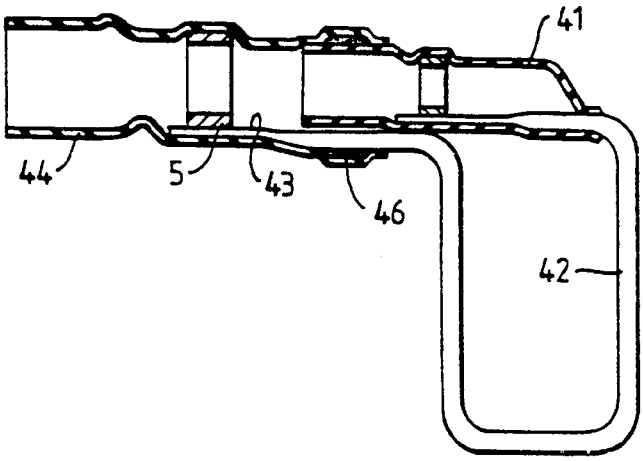

By way of comparison, a known coaxial cable termination device is shown in FIG. 6*a* and *b*. In order to manufacture the known device a small heat-recoverable polyvinylidine fluoride sleeve 41 is recovered onto a solder ring 4 and one end of a wire 42. The wire is bent into a substantially rectangular shape with its other end 43 extending beyond the end of the sleeve. A second, larger sleeve 44 is partially recovered onto a solder ring 5 and a ring 46 of uncrosslinked hot-melt adhesive, for example based on polyethylene. The sleeve 44 is then positioned over the end of the sleeve 41 and the free end 43 of the wire 42 is positioned inside the sleeve 44 so that it is adjacent to the solder ring 5. The assembly is briefly heated so that the sleeve 44 partially recovers about the sleeve 41 and the adhesive ring 46 melts and bonds the two sleeves together.

Figure 7:
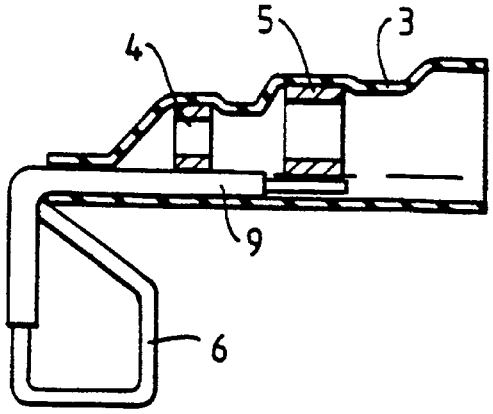
FIG. 7 is a sectional elevation showing a second form of device according to the invention.

FIG. 7 shows another form of device according to the invention which is a slight modification of the device shown in FIG. 1. The device is essentially the same as that shown in FIG. 1 with the exception that the end portions 8 and 9 of the wire 6 extend along the channels in the heat-recoverable sleeve 3 and are located between the solder rings 4 and 5 and the sleeve wall. The sleeve may be partially recovered in order to grip the end portions of the wire against the solder. This method of securing the wire 6 in the sleeve 3 obviates the necessity for a "U" shaped part of the wire as shown in FIG. 1.

Figure 8:
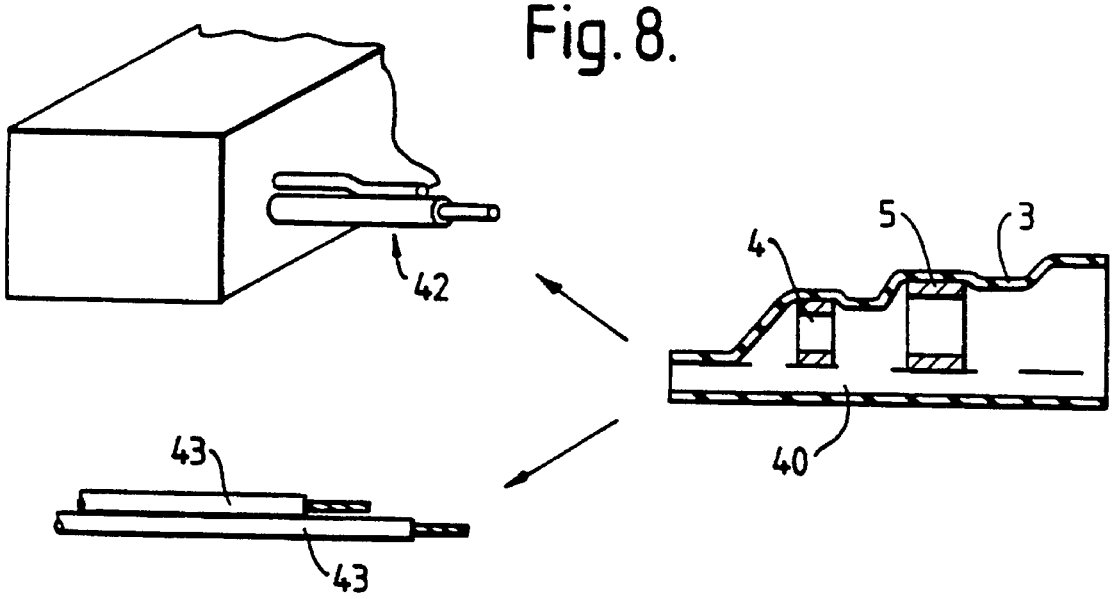
FIG. 8 is an end view of the sleeve employed in the device of FIG. 7.
Figure 9:
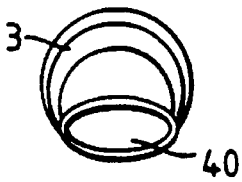
FIG. 9 is a side view of the sleeve employed in the device of FIG. 7 together with a number of alternative conductive members.

The sleeve employed in this form of device is shown in FIGS. 8 and 9. The sleeve has a guide channel 40 that receives the end portions of the wire and limit insertion of the wire to the correct extent. The sleeve may, if desired, have a pair of guide channels, one for each conductor, in which case the channels may be of differing bores, the larger bore of one of the channels being required to accommodate the insulating sleeve 7 of the wire 6.

The sleeve shown in FIGS. 8 and 9 may be sold separately from the wire. It may then be employed with a wide range of different conductive members of the same general configuration as that of the end portions of the wire 6. For example it may be recovered onto pins on a strip in the manner of FIGS. 2 to 5 or it may be recovered onto connector pins 42 or even pre stripped wires 43.

We claim:

1. A device arranged to electrically connect a coaxial cable to an electrical component, said device comprising a sleeve arranged to receive an end of the coaxial cable, the sleeve having an interior and:

(a) a pair of elongate conductive members that extend out of the sleeve from the interior thereof, and being arranged to form a connection with said electrical component; and (b) two quantities of solder arranged to connect each said conductive member to a conductor of said coaxial cable;

wherein said sleeve is a unitary sleeve and said conductive members both extend out of a first end of the sleeve; and wherein at least one of said elongate conductive member is electrically insulated in order, in use, to prevent a short circuit between said conductive members.

2. A device as claimed in claim 1, wherein the sleeve is dimensionally heat-recoverable.

3. A device a claimed in claim 1 wherein a portion of at least one of said conductive members is bent double where it exits said sleeve, thereby gripping said sleeve.

4. A device as claimed in claim 1 wherein said sleeve has been partially recovered thereby to grip the elongate conductive members against the solder.

5. A device as claimed in claim 1, wherein said conductive members are joined together outside said sleeve.

6. A plurality of devices as claimed in claim 1, said devices being located on a strip which joins at least one of said conductive members of each device.

7. A dimensionally heat-recoverable sleeve arranged to connect a coaxial cable having two electrical conductors to a pair of elongate conductive members, said sleeve being of unitary form and containing two quantities of solder arranged to connect each conductive members to a respective said one of said conductors of said coaxial cable, and said sleeve having a guide channel to allow insertion of a pair of elongate conductive members therein so that each said conductive member can be inserted only as far as a different quantity of solder.

* * * * *